US008091740B2

(12) United States Patent
Zur Muhlen

(10) Patent No.: US 8,091,740 B2
(45) Date of Patent: Jan. 10, 2012

(54) DISPENSER, IN PARTICULAR, METERING DISPENSER

(75) Inventor: Anette Zur Muhlen, Krefeld (DE)

(73) Assignee: Stockhausen GmbH, Krefeld (DE)

( * ) Notice: Subject to any disclaimer, the term of this patent is extended or adjusted under 35 U.S.C. 154(b) by 0 days.

(21) Appl. No.: 12/829,197

(22) Filed: Jul. 1, 2010

(65) Prior Publication Data

US 2010/0288792 A1 Nov. 18, 2010

Related U.S. Application Data

(63) Continuation of application No. 10/578,051, filed as application No. PCT/EP2005/053882 on Aug. 5, 2005, now abandoned.

(51) Int. Cl.
*B67D 7/06* (2010.01)

(52) U.S. Cl. ..... 222/181.3; 222/185.1

(58) Field of Classification Search ..... 222/181.3, 222/181.2, 207, 235, 214, 181.1, 180, 185, 222/186, 185.1, 183
See application file for complete search history.

(56) References Cited

U.S. PATENT DOCUMENTS

| | | | | | |
|---|---|---|---|---|---|
| 701,980 | A | * | 6/1902 | Withman | 141/268 |
| 809,896 | A | * | 1/1906 | Bender | 222/517 |
| 1,094,615 | A | * | 4/1914 | Watrous | 222/153.03 |
| 1,220,753 | A | * | 3/1917 | Kees | 222/131 |
| 3,881,641 | A | | 5/1975 | Pliml et al. | |
| 4,164,306 | A | * | 8/1979 | Perrin | 222/181.2 |
| 4,256,242 | A | | 3/1981 | Christine | |
| 4,349,133 | A | | 9/1982 | Christine | |
| 4,561,571 | A | * | 12/1985 | Chen | 222/207 |
| 4,690,307 | A | | 9/1987 | Hogan | |
| 4,715,517 | A | | 12/1987 | Potter et al. | |
| 4,741,461 | A | * | 5/1988 | Williamson et al. | 222/181.2 |
| 5,014,880 | A | * | 5/1991 | Loesel et al. | 222/181.2 |
| 5,105,992 | A | | 4/1992 | Fender | |
| 6,062,425 | A | | 5/2000 | Brown et al. | |
| 6,131,773 | A | | 10/2000 | Wade et al. | |
| 6,152,330 | A | * | 11/2000 | Polan | 222/156 |
| 6,189,740 | B1 | * | 2/2001 | Wade et al. | 222/207 |
| 6,729,503 | B2 | * | 5/2004 | DeKoning et al. | 222/183 |
| 6,808,090 | B2 | * | 10/2004 | Pedersen | 222/181.3 |
| 7,066,356 | B2 | * | 6/2006 | Schuman et al. | 222/153.01 |
| 2003/0071058 | A1 | | 4/2003 | Studer | |

FOREIGN PATENT DOCUMENTS

| | | | |
|---|---|---|---|
| DE | 19536739 | A1 | 4/1997 |
| EP | 450687 | A1 | 10/1991 |
| EP | 1090577 | A2 | 4/2001 |
| WO | 9012530 | A1 | 11/1990 |
| WO | 03059524 | A1 | 7/2003 |

* cited by examiner

*Primary Examiner* — Lien Ngo
(74) *Attorney, Agent, or Firm* — Stetina Brunda Garred & Brucker

(57) ABSTRACT

The invention concerns a dispenser, in particular for semi-solid or liquid systems, with a housing to hold a dispenser unit which is formed by a storage container, a metering unit (3) connected therewith via which the substance can be output in defined doses and an activation mechanism (4) which can activate the metering unit (3) to output a dose of substance, where the dispenser unit is held via a reservoir holder (5) in the housing (1). Known dispensers have the disadvantage that the dispenser unit is not held securely against tipping. The invention avoids this in that the storage container (2) is formed with a lower volume area (2") and an upper volume area (2') which to form the reservoir holder between its upper and lower end has a constricted shoulder area (9) with an inwardly angled setting surface, where the housing (1) has a corresponding support surface (10) to support the setting surface.

34 Claims, 2 Drawing Sheets

DISPENSER, IN PARTICULAR, METERING DISPENSER

CROSS-REFERENCE TO RELATED APPLICATIONS

The present application is a continuation patent application of U.S. patent application Ser. No. 10/578,051, filed on Feb. 28, 2007 now abandoned which claims the benefit of PCT application Ser. No. PCT/EP05/53882, filed on Aug. 5, 2005 which is based on German Patent Application Ser. No. 10 2004 038 232.8 filed on Aug. 5, 2004, the entire contents of which are incorporated herein by reference.

STATEMENT RE: FEDERALLY SPONSORED RESEARCH/DEVELOPMENT

Not Applicable

BACKGROUND

The invention concerns a dispenser, in particular a metering dispenser for semi-solid or liquid systems, with a housing to hold a dispenser unit which is formed from a storage container for a substance to be administered and a metering unit connected with the storage container via which the substance can be emitted in defined doses, and with a control mechanism which can be activated to emit the defined dose of the substance according to the dosing unit by means of an applied activation force, the dispenser unit being held in the housing via a reservoir holder.

BRIEF SUMMARY

Dispensers, in particular metering dispensers of this type are known from international patent application WO 03/059524 A1. The known foam dispenser has a housing and a storage container arranged in the housing, where the housing is formed by a rear wall which is wall-mountable and a swivel cover mounted swivellably on this rear wall.

In the lower area the rear wall has a forward protruding carrier plate which has a clamping holder for the metering unit. The dispenser unit formed by the metering unit and storage container can be held on the rear wall, where a retaining force is required which prevents tilting of the storage container until the swivel cover is closed. The swivel cover is formed bell-like and after closure surrounds the entire dispenser unit with rear wall. The metering unit in the known foam dispenser is formed as a foam pump.

Although in known dispensers the dispenser units are easy and simple to replace, they have the disadvantage that firstly until the swivel cover is closed the storage container can tilt which leads to a comparatively high bending moment being applied to the clamping holder of the metering unit due to the weight of the substance in the storage container, and secondly a retaining force being required which holds the dispenser unit in position until the swivel cover is closed. The result is the further disadvantage that the dispenser unit can tip out again if the swivel cover is not securely closed.

In addition dispensers are known from WO 00/10131, DE 195 36 739, DE 42 10 591 and WO 90/12530 in which essential function parts of the metering device are arranged in the housing. In these dispensers there is no dispenser unit in which the metering unit and storage container form a functional whole. The arrangement of the metering unit on the storage container however leads to a far simpler design of housing, allows more hygienic use and cleaning of the dispenser and substantially facilitates the exchange of the storage container.

With the dispenser disclosed in DE 199 36 739 the metering unit with storage container forms a function unit but the activation necessary to emit the dose is achieved by lateral compression of the storage container walls. Here single-hand operation of the dispenser of DE 199 36 739 is excluded. In addition the dispenser unit can only be introduced into a holder from above which makes it substantially more complex and time-consuming than a simple front insertion.

A further disadvantage of the storage container of DE 199 36 739 is that because of its integral function as a pump unit this cannot be fitted with collapsing walls, which necessarily requires a ventilation facility and hence the resulting risk of contamination of the container content cannot be effectively excluded.

The object of the invention is therefore to create a dispenser for soap in liquid or foam consistency or other media which with maximum stability can be produced simply and economically and be filled by simple replacement of the storage container.

A further object of the invention is to hold the dispenser unit in the housing as secure against tilting as possible and allow particular hygienic operation of the dispenser.

This object is achieved according to the invention in that the storage container has an upper volume area, a lower volume area and to form the reservoir holder a collar-like clamping holder, where the metering unit is arranged at the lower end of the lower volume area and the force exerted by the reservoir holder to the dispenser unit for a secure mounting in the housing is applied in an area between the centre of gravity of the filled and properly installed dispenser unit and the upper end of the upper volume area.

The invention further relates to a dispenser unit for use in the housing of the said dispenser.

This object is achieved according to the invention furthermore by a dispenser of the type cited initially in which the storage container is formed with a lower volume area and an upper volume area, where the metering unit is arranged at the lower end of the lower volume area and to form the reservoir holder has between its upper and lower end a constricted shoulder area with a setting surface angled inwards at an angle $\gamma$ to the side wall of the volume area, where the housing has a corresponding support surface on which the setting surface of the shoulder area can be placed, and where the force exerted by the reservoir holder on the dispenser unit for its secure mounting in the housing is applied in the area of the centre of gravity of the properly installed and filled dispenser unit.

Due to the design of the dispenser according to the invention the dispenser unit is now held securely in the housing. As before it can be installed easily by simple push fit or insertion in the clamping holder and removed again for replacement. Due to the clamping holder arranged higher now the distribution of moments on eccentric arrangement of the storage container is substantially more favourable and the resulting bending forces on the clamping holder are reduced.

In particular with the use of dispenser units, the walls of which are made of thin film-like material, a reduction in bending moment is favourable. Kinking of the wall can be avoided and even if the housing is not closed due to a defect in the catch or incorrect operation, the dispenser unit sits securely in the clamping holder. Despite this the advantage of possible single-handed filling of the housing with the dispenser unit is not lost.

Preferably the collar-like holder is formed as a reinforced ring arranged in the dispenser unit. In this preferred embodiment the storage container is produced as one piece in the blow-moulding process. The lower volume area is here formed by a constriction in the contour and preferably has a thicker wall. The reservoir holder can be formed by a U-shaped fork in which the lower volume area can be inserted.

Alternatively to the above embodiment the storage container can also be made of two pieces, where the upper volume area is connected via a screw connection with the lower area. The reinforced ring of the collar-like clamping holder in this case can be formed by a flange ring fitted with an internal thread on the upper volume area or lower volume area depending on which component the inner thread is provided.

The objects of the invention are furthermore achieved by a dispenser of the type cited initially in which the storage container is formed with a lower volume area and an upper volume area, where the metering unit is arranged at the lower end of the lower volume area and where the shoulder area to form the reservoir holder has between its upper and lower end a constricted shoulder area with a setting surface angled inwards at an angle $\gamma$ to the side wall of the volume area, where the housing has a corresponding support surface on which the setting surface of the shoulder area can be placed, and where the force exerted by the reservoir holder on the dispenser unit for its secure mounting in the housing is applied in the area of the centre of gravity of the properly installed and filled dispenser unit. The invention further relates to a dispenser unit for use in the housing of the said dispenser.

The further design of the dispenser according to the invention offers the additional advantage that in the upper volume area of the storage container is provided a constricted shoulder area which can be placed on a corresponding support surface of the housing. The constricted shoulder area is formed by a linear or curved area which is drawn inwards.

In the case of a linear area this can be drawn inwards at an angle $\gamma$ relative to the side wall where the angle $\gamma$ is here formed by the angle between the virtual extension of the storage container downwards and the linear side wall. The corresponding support surface of the housing has the negative form of the drawn shoulder area. This support surface too as already stated can be formed fork-like, similar to the collar-like clamping holder described above so that on both sides of the storage container it has a support surface on which the setting surface of the inwardly tapering support area can be placed.

The angle $\gamma$ by which the constricted support area is angled inwards is preferably between 10° and 170°. This allows firstly a complete drainage of the medium from the storage container and secondly guarantees a sufficiently secure support, smaller angles being preferred with more stable materials of the storage container i.e. in particular in the case of a plastic container with large wall thicknesses. The setting surface can be formed as a peripheral ring surface or only in the area of the side walls of the storage container which are adjacent to the rear wall of the housing. In the case of round bottles a semi-circular setting surface can be provided, the same naturally applies to elliptical or other bottle forms where the setting surface can always be adapted to the bottle form.

So that the storage container can be inserted in the housing in a clear orientation, the setting surface to achieve this unambiguity is not formed rotationally symmetrical, which is achieved either by a corresponding shaping of the setting surface or for example by a raised area on one of the sides. Corresponding shaping of the support surface guarantees that the setting surface formed in this way can be used only in one orientation. Preferably the housing is structured so that it can only be closed when the setting surface is placed in the correct orientation on the support surface, and the storage container is inserted as low as possible.

In principle the setting surface and support surface can be formed as required as long as the support function is retained. This includes either the setting surface or the support surface being formed by a linear surface i.e. an edge protruding in the direction of the opposing surface and resting on this opposing surface. The edge can be a peripheral edge so a spot load is also possible, where for example the setting surface or support surface can be formed by two or four protruding support points.

A further preferred embodiment of the dispenser has a form-fit connection between the upper volume area and the lower volume area with the support surface, where here a bead is arranged between the upper volume and the lower volume area, into which bead can be inserted the U-shaped area with the support surface. In this embodiment the setting surface is formed by the upper edge of the bead.

It is also possible for the U-shaped support surface to hold the constricted shoulder area by engagement. This is particularly advantageous as here after overcoming the insertion force the dispenser unit is automatically drawn into the necessary position. Such an embodiment can for example be achieved if the U-shaped opening, viewed from the back plate, first has an expanding cross section and then a slightly tapering cross section. The material of the support surface must then be selected so flexible that on insertion of the dispenser unit, the fork thus formed can spring apart and spring back again after passage of the largest cross section of the constricted shoulder area. A cross section expanding again to the front can, in this fork, facilitate insertion of the constricted shoulder area.

Alternatively the support surface can also be formed as a closed or almost closed circle, where the dispenser unit is inserted from above through the support surface. Here the inner diameter of the support surface must naturally be greater than the greatest outer diameter of the lower volume area so that the lower volume area can be guided through the support surface.

In all embodiments the lower volume area can have a lower second section, angled at the side, which is attached to the first e.g. linear section. Below the connection with the housing in the area of the collar-like clamping holder or the constricted shoulder area, the second section of the lower volume area is then preferably angled to the side about an angle $\alpha$ relative the first linear section. This angle $\alpha$ can be less than 40°, preferably however it is less than 30°. Such lower volume areas can also easily be produced in the blow-moulding process so that the entire dispenser unit can be economically produced from one piece of a material where desired.

For form stabilisation, the second lower area can have reinforcement elements in particular ribs or embossed beads which can run both axially and radially. The optimum course depends on the arrangement of support elements which hold the dispenser unit in the housing.

Preferably the control mechanism is a push button. This push button is mounted swivellable on the housing and transmits a pressure force by the operator to the metering unit. The metering unit can have a nozzle which is opened by activation of the pressure force so that a pre-defined dose of the substance to be dispensed is released. Such nozzles and metering units are generally known.

For aesthetic reasons, preferably the push button is formed by a flat plate which is arranged substantially in the plane of the housing front. It can be set at a slight angle to this or protrude slightly from the housing plane. The push button is connected swivellably with the housing and at its lower end can have a control pin which transfers the pressure force applied to the metering unit.

To guarantee a secure and pleasant function of the dispenser, the contact surface of the push button relative to the contact surface of the metering unit should be angled by an angle β which is less than 90°. This means that during the activation movement the contact surface of the push button slides on the contact surface of the metering unit but the contact surface of the metering unit is moved. In this way larger activation paths are achieved and a more favourable transfer of force, in particular the contact force in weakened on very rough activation. This makes the dispenser less susceptible to damage as a result of rough activation.

In a particularly preferred embodiment the push button is integrated in the housing and is in particular formed by the housing itself. In this case the housing can be attached swivellably to a base part mounted on the wall and in the lower area rests with its contact surface against the metering unit. The spring here then preferably connects the base part with the swivellable cover part to prevent the user being able undesirably to swivel up the cover and for example remove the dispenser unit. At the same time the spring ensures the reset of the push button formed by the cover part.

The lower volume area can also form a fluid-tight channel between the metering unit and the storage container. In this case the lower volume area is formed as a hose with a constant or reducing cross-section. This hose can be dimensionally stable or flexible. It must naturally be ensured that the metering unit is held position-stable in the dispenser i.e. where applicable a special holder for the metering unit must be provided which could be connected with the base part.

Alternatively the holder for the metering unit can naturally also be connected with an upper part of the dispenser unit. This can take place via webs or fixing plates continuing in the direction of the metering unit. The lower volume area can at least in sections be formed with a concertina-like wall area to simplify installation.

One embodiment example of the invention can have such a web-like or tubular spacer which connects the metering connection with the upper volume area. Through the spacer or at the side next to the spacer, the lower volume area can be arranged as a flexible hose with for example a concertina-like wall.

The metering unit is attached to the spacer so that the position of the metering unit is specified by the spacer. This design as before allows the entire dispenser unit to be replaced for refilling. This is preferred at present as the metering units are regarded as consumables. If however a metering unit is used which cannot be replaced, the spacer could also be connected with the housing itself so that only the upper volume area can be replaced either together with or without the lower volume area.

The dispenser described above is used for example as a foam dispenser. In this case the metering unit is a metering pump which allows a liquid substance in the storage container to be foamed by the activation movement. The metering pump is usually a mechanical pump. To avoid the lower volume area springing away when a pressure force is applied in the direction of the wall, the housing in the lower area can have a pressure brace against which the lower volume area can rest. This design is of particular interest if the connection of the dispenser unit with the housing is made in the upper area of the dispenser unit, so a pressure force applies a comparatively large force to the dispenser unit.

The pressure brace can at least in sections have the negative form of the outer contour of the lower volume area so that it lies flat on the lower volume area. This contact can be permanent or exist only when a pressure force is applied. A permanent contact could be considered for example if the dispenser unit is held in the upper area via the setting and support surface and the lower volume area is comparatively flexible. In this case the lower volume area would automatically lie on the pressure brace after insertion of the dispenser unit.

If the material of the lower volume area is so flexible that there is a risk that the lower volume area will be crushed under the pressure force, the pressure brace can be guided to the metering unit and can even, with a front end, hold the metering unit for example via a U-shaped fork holder.

BRIEF DESCRIPTION OF THE DRAWINGS

Further features and advantages of the invention arise in sub-claims and the description below of preferred embodiment examples with reference to the drawings. The drawings show:

DETAILED DESCRIPTION

Figure 1:
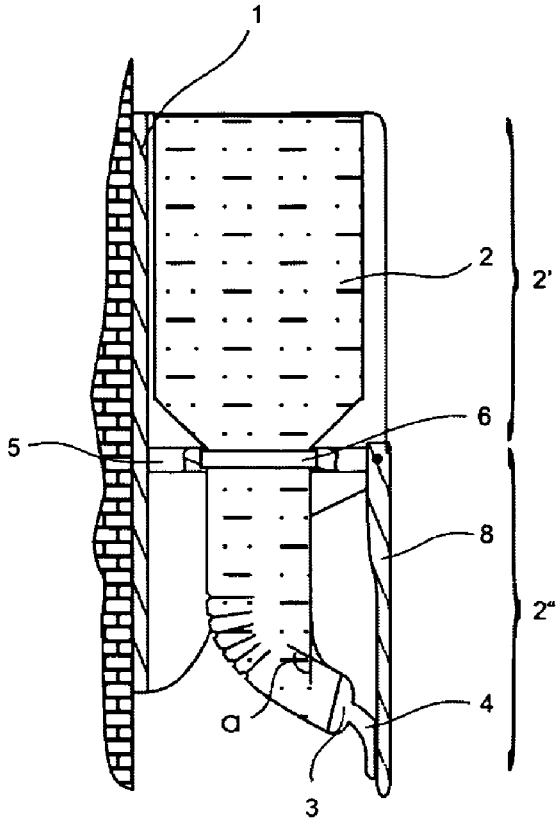
FIG. 1: a side view of a first embodiment of a dispenser in cross section.

FIG. 1 shows a dispenser with a housing 1. The housing 1 has a rear wall and a cover swivellably connected with the rear wall in the upper area, shown in dotted lines in the figure. In the housing 1 is held a storage container 2 which for example contains a liquid soap or similar.

The fluid is dispensed to the user via a metering unit 3 where in the example shown the metering unit 3 is a commercial foam pump via which the liquid is foamed. For activation the dispenser has a push button 8 which is arranged swivellably on the cover and rests with its inside on the metering unit 3 when a pressure force is applied.

The storage container 2 is divided into an upper volume area 2' containing a substantial part of the fluid and a lower volume area 2" arranged below this which connects the metering unit 3 with the volume area 2' such that the push button 8 acts on the activation element of the metering unit 3. For this the lower part of the lower volume area 2" is angled by an angle α relative to the upper area.

The storage container is connected with the housing in the transitional area between the volume area 2' and the lower volume area 2". For this the end area of the lower volume area 2" is formed with a collar-like clamping holder 6 which is inserted clamping in a reservoir holder 5. The reservoir holder 5 is essentially a fork-like holder in which can be inserted the collar-like clamping holder 6.

Figure 2:
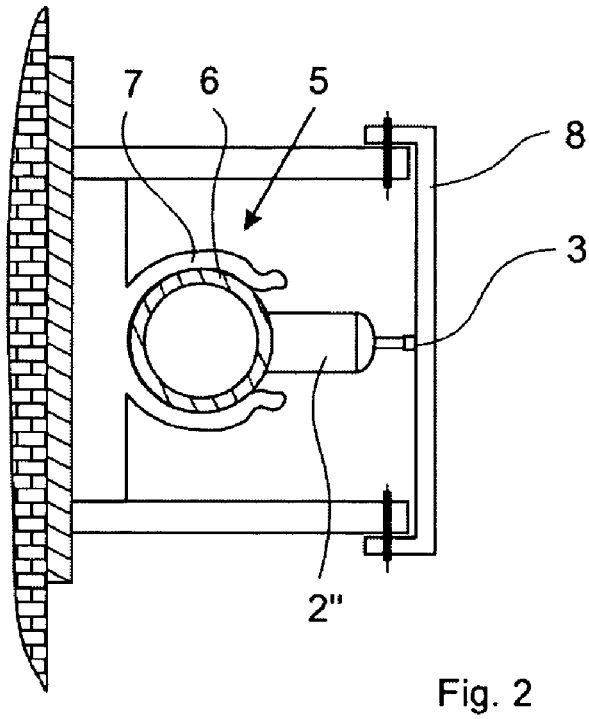
FIG. 2: a top view of the clamping holder of the dispenser in FIG. 1.

FIG. 2 shows the area of the reservoir holder 5 in a detailed view. The fork is closed slightly in the front area so that it can surround the collar-like clamping holder 6 with engagement. In the upper and lower area in FIG. 2 is a holder for swivellable mounting of the push button 8.

Figure 3:
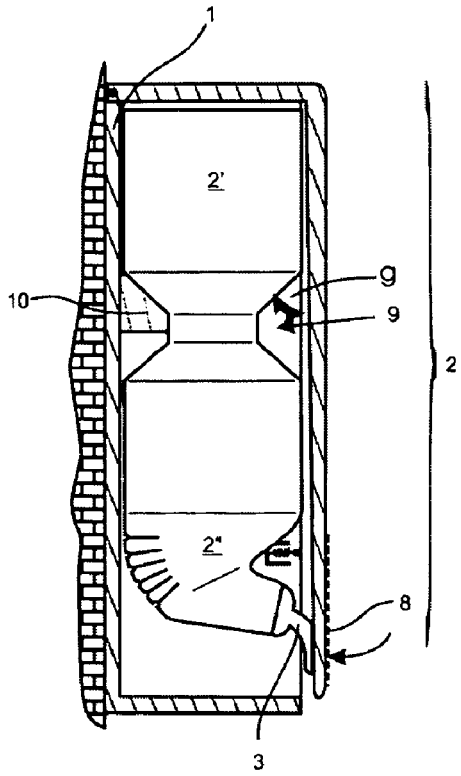
FIG. 3: a side view of a further embodiment of a dispenser.

FIG. 3 shows a further embodiment of the invention. The storage container 2 here has a constricted shoulder area 9 via which the storage container 2 can be attached to the housing 1. The housing 1 for this in the area of the constricted shoulder area 9 has an additional mounting ring with a support surface 10. The upper volume area 2' has a setting surface which is formed by the upper edge of the constricted shoulder area 9. For this the wall of the upper volume area 2' is angled inwards by an angle γ.

The storage container 2 can be made of one piece in the blow-moulding process. The shape in the area of the constricted shoulder area 9 guarantees sufficient form stability. In the lower area the cross-section of the storage container 2 expands again to utilise the maximum volume. This design has the particular advantage that the force is applied not in the lower area but in the area of the centre of gravity. This leads to a secure mounting without load from excessive tipping moments so that even with the housing 1 opened, a secure support of the storage container 2 is guaranteed.

In the embodiment example shown in FIG. 3 the front area of the housing is formed completely as a swivel cover which also performs the function of a push button 8. For this the metering unit 3 rests with the activation button on the inside of the lower part of the swivel cover. A spring connected with the housing, shown diagrammatically only, prevents undesirable opening of the housing by unauthorised persons and presses the lower part of the swivel cover forming the push button 8 against the metering unit 3.

The constricted shoulder area 9 can also have a locking facility for the storage container 2. For this for example the storage container 2 could have a laterally projecting bead which can be pressed into a groove in the support surface. This holds the storage container additionally and by an audible click indicates to the filler that the storage container is completely and correctly inserted.

Figure 4:
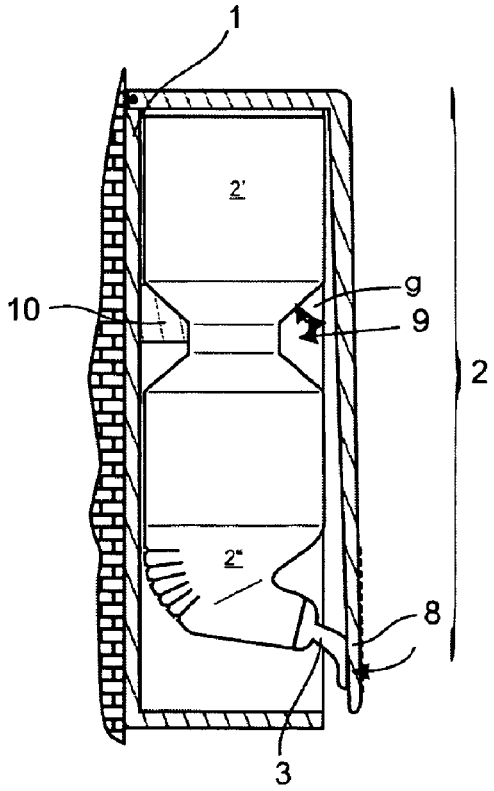
FIG. 4: a side view of a third embodiment of a dispenser.

FIG. 4 shows a third embodiment of a dispenser. Here the push button 8, as in the embodiment shown above in FIG. 2, is formed by the housing 1. However here there is no return spring but the spring effect of the storage container 2 is utilised to return the push button 8. Otherwise this embodiment does not differ from the variant shown in FIG. 3.

What is claimed is:

1. A metering dispenser for a flowable substance, the metering dispenser comprising:

a housing;

a storage container configured for storing the flowable substance, the storage container having an upper volume area, a lower volume area and a constricted shoulder area between the upper and lower areas, the constricted shoulder area being narrower compared to the upper and lower areas and between a center of gravity of the installed storage container and an upper end of the upper volume area, the storage container being configured to be insertable into the housing in an insertion orientation with gravity causing the flowable substance to flow from the upper volume area to the lower volume area;

a metering unit connected to the storage container and disposed adjacent to a lower end of the lower volume area of the storage container, through which the substance can be dispensed in defined doses;

a manually actuatable activation mechanism coupled to the housing and moveable relative to the storage container between a dispensing position and a normal position, the activation mechanism being configured to emit the defined dose of the flowable substance in response to movement of the activation mechanism from the normal position toward the activation position; and a reservoir holder coupled to the housing and defining a fork-like holder, the fork-like holder having a frontal opening sufficiently wide to receive the constricted shoulder area therethrough, the fork-like holder engageable with the storage container at the constricted shoulder area so that the reservoir holder supports the storage container above the center of gravity of the installed storage container to mitigate tilting when installing the filled storage container in the housing.

2. The dispenser of claim 1 wherein the fork-like holder is formed as a semi-circularly shape.

3. The dispenser of claim 2 wherein the upper volume area and the lower volume area are threadably connectable and a reinforced ring of a collar-like clamp of the shoulder area is formed by a flange ring with an internal thread on the upper volume area or the lower volume area.

4. A metering dispenser for a flowable substance, the metering dispenser comprising:

a housing;

a storage container configured for storing the flowable substance the storage container having an upper volume area, a lower volume area and a constricted shoulder area between the upper and lower areas, the constricted shoulder area being narrower compared to the upper and lower areas and between a center of gravity of the installed storage container and an upper end of the upper volume area, the storage container being configured to be insertable into the housing in an insertion orientation with gravity causing the flowable substance to flow from the upper volume area to the lower volume area;

a metering unit connected to the storage container and disposed adjacent to a lower end of the lower volume area of the storage container, through which the substance can be dispensed in defined doses;

a manually actuatable activation mechanism coupled to the housing and moveable relative to the storage container between a dispensing position and a normal position, the activation mechanism being configured to emit the defined dose of the flowable substance in response to movement of the activation mechanism from the normal position toward the activation position; and a reservoir holder coupled to the housing and defining a fork-like holder, the fork-like holder having a frontal opening sufficiently wide to receive the constricted shoulder area therethrough, the constricted shoulder area defines a setting surface angled inwards at an angle γ to a side wall of the upper volume area, and wherein the housing has a corresponding support surface and the setting surface of the constricted shoulder area is supportable on the housing support surface, and wherein a force exerted by the reservoir holder on the storage container for its secure mounting in the housing is applied in the shoulder area so that the reservoir holder supports the storage container above the center of gravity of the installed storage container to mitigate tilting when installing the filled storage container in the housing.

5. The dispenser of claim 4 wherein that the angle γ is between about 10° and about 170°.

6. The dispenser of claim 4 wherein the support surface is formed as a peripheral ring surface.

7. The dispenser of claim 4 wherein the resevoir holder is formed such that the storage container can be inserted in the housing in only one position.

8. The dispenser of claim 4 wherein the setting surface and support surface are connectably lockable to each other.

9. The dispenser of claim 4 wherein the setting surface and the support surface are flat surfaces.

10. The dispenser of claim 4 wherein the setting surface and the support surface are curved surfaces.

11. The dispenser of claim 4 wherein the support surface is a U-shaped area of the housing which is surroundable about the upper volume area.

12. The dispenser of claim 11 wherein the U-shaped support surface is flexible such that a U-shaped opening of the U-shaped surface has an expanding cross-section and a tapering cross section so that the lower volume area is insertable into the U-shaped support surface.

13. The dispenser of claim 4 wherein the support surface has a circular configuration, an inner diameter of the support surface is sized to the greatest outer diameter of the lower volume area such that the inner diameter of the support surface is smaller than a greatest outer diameter of the lower volume area and the lower volume area can he pushed into the support surface.

14. The dispenser of claim 4 wherein a first section of the lower volume area extends straight down and a second section of the lower volume area extends at an angle $\alpha$ relative to the first section.

15. The dispenser of claim 14 wherein the angle $\alpha$ is less than about 40°.

16. The dispenser of claim 15 wherein the angle $\alpha$ is less than about 30°.

17. The dispenser of claim 14 wherein the second section includes ribs or embossed beads sized and configured for form stabilization.

18. The dispenser of claim 4 wherein the activation mechanism comprises a push button which is swivellably mounted on the housing and is operative to transmit a pressure force to the metering unit, wherein the metering unit has a nozzle activatable under pressure and allows the defined dose of the substance to be output when nozzle is activated.

19. The dispenser of claim 18 wherein the push button is formed by a flat plate and a force transfer means arranged on a side of the flat plate facing the metering unit and connected with the flat plate by a control pin which acts on the metering unit.

20. The dispenser of claim 18 wherein the push button is formed by a flat plate, a contact surface of the flat plate facing the metering unit is angled relative to a contact surface of the metering unit by an angle $\beta$ which is less than about 90°.

21. The dispenser of claim 4 wherein the housing comprises a base part which can be mounted on a wall and a cover part swivellable on the base part for filling, wherein the cover part forms a push button.

22. The dispenser of claim 4 wherein the lower volume area forms a fluid-tight channel between the metering unit and the storage container.

23. The dispenser of claim 4 wherein the lower volume area has a curved section and a concertina-like wall area.

24. The dispenser of claim 4 wherein the lower volume area is formed as a flexible hose.

25. The dispenser of claim 4 further comprising a web-like or tubular spacer that connects an end facing a metering connection of the lower volume area with the upper volume area.

26. The dispenser of claim 4 wherein the metering unit is formed as a metering pump and the liquid substance in the storage container can be foamed by activation movement before output in the defined dose.

27. The dispenser of claim 26 wherein the metering pump is a mechanical pump.

28. The dispenser of claim 4 wherein a lower area of the housing has a pressure support on which the lower volume area can rest when a pressure force is exerted on the metering unit.

29. The dispenser of claim 28 wherein the pressure support is disposed at least partially on an outer casing surface of the lower volume area over a wide surface.

30. A dispenser comprising:

a housing;

a storage container for containing a flowable substance to be administered, the storage container insertable into the housing, the storage container defining a constricted shoulder area at a center of gravity of the filled storage container;

a metering unit connected to the storage container wherein the flowable substance can be emitted in defined doses; and an activation mechanism in operative communication with the metering unit for activating the metering unit to emit a defined dose of the flowable substance under an applied activation force, the improvement comprising:

the storage container having a lower volume area and an upper volume area, wherein the metering unit is arranged at the lower volume area, a fork-like holder between the upper and lower volume areas has a frontal opening sufficiently wide to receive the constricted shoulder area therethrough, the constricted shoulder area has a setting surface angled inwards at an angle $\gamma$ to a side wall of the upper volume area, which is cooperative with a support surface of the housing of the dispenser, the setting surface of the shoulder area is placeable on the support surface of the dispenser housing.

31. The dispenser of claim 4, wherein the manually actuatable activation mechanism is integrally formed with the housing.

32. The dispenser of claim 1 wherein the center of gravity of the installed storage container is below the constricted shoulder area of the storage container where the fork-like clamp is engaged.

33. The dispenser of claim 32 wherein the center of gravity of the storage container is vertically below the reservoir holder.

34. The dispenser of claim 4 wherein the center of gravity of the storage container is vertically below the constricted shoulder area of the storage container.

* * * * *